US007595765B1

(12) United States Patent
Hirsch et al.

(10) Patent No.: US 7,595,765 B1
(45) Date of Patent: Sep. 29, 2009

(54) EMBEDDED SURFACE WAVE ANTENNA WITH IMPROVED FREQUENCY BANDWIDTH AND RADIATION PERFORMANCE

(75) Inventors: Vincent A. Hirsch, Boulder, CO (US); Bradley M. McCarthy, Torrance, CA (US); Thomas S. Watson, Thornton, CO (US); John Mehr, Superior, CO (US); Thomas M. Crawford, Westminster, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 513 days.

(21) Appl. No.: 11/479,431

(22) Filed: Jun. 29, 2006

(51) Int. Cl.
*H01Q 1/42* (2006.01)

(52) U.S. Cl. ..... 343/789; 343/846; 343/873

(58) Field of Classification Search ..... 343/700 MS, 343/846, 848, 872, 873, 753, 789
See application file for complete search history.

(56) References Cited

U.S. PATENT DOCUMENTS

| | | | | |
|---|---|---|---|---|
| 2,648,002 | A | 8/1953 | Eaton | |
| 2,822,542 | A | 2/1958 | Butterfield | |
| 2,852,775 | A | 9/1958 | Zisler et al. | |
| 2,985,877 | A | 5/1961 | Holloway | |
| 3,099,836 | A | 7/1963 | Carr | |
| 3,611,395 | A | 10/1971 | Carberry | |
| 3,868,694 | A | 2/1975 | Meinke | |
| 4,001,834 | A | 1/1977 | Smith | |
| 4,010,475 | A | 3/1977 | James | |
| 4,087,822 | A | 5/1978 | Maybell et al. | |
| 4,162,499 | A | 7/1979 | Jones, Jr. et al. | |
| 4,170,013 | A | 10/1979 | Black | |
| 4,197,544 | A | 4/1980 | Kaloi | |
| 4,370,657 | A | 1/1983 | Kaloi | |
| 4,401,988 | A | 8/1983 | Kaloi | |
| 4,415,900 | A * | 11/1983 | Kaloi | 343/700 MS |
| 4,835,543 | A | 5/1989 | Sequeira | |
| 4,839,659 | A | 6/1989 | Stern et al. | |
| 4,879,562 | A | 11/1989 | Stern et al. | |
| 4,931,808 | A | 6/1990 | Lalezari et al. | |
| 5,126,751 | A | 6/1992 | Wada et al. | |
| 5,389,937 | A | 2/1995 | Kaloi | |
| 5,465,100 | A * | 11/1995 | Remondiere et al. | 343/769 |
| 5,471,221 | A | 11/1995 | Nalbandian et al. | |

(Continued)

OTHER PUBLICATIONS

Park, et al., "An Ultra-Wideband Microwave Radar Sensor for Characterizing Pavement Subsurface", IEEE MTT-S Digest, 2003, IFWE-63, pp. 1443-1446.

(Continued)

*Primary Examiner*—Tan Ho
(74) *Attorney, Agent, or Firm*—Sheridan Ross P.C.

(57) ABSTRACT

Embedded surface wave antenna elements incorporating different dielectric materials or other features are provided. The different dielectric materials can arranged adjacent a feed, to absorb energy that can cause undesirable reflections in the antenna element. In addition or alternatively, different dielectric materials can be arranged to alter the velocity of energy through the antenna element, and to control or attenuate the formation of nulls in the far field at angles of interest. The control or attenuation of nulls in the far field at angles of interest can further be controlled through contouring an antenna element ground plane in a lens region of the antenna element. A buried feed arrangement is also described.

21 Claims, 7 Drawing Sheets

U.S. PATENT DOCUMENTS

| | | | | |
|---|---|---|---|---|
| 5,561,435 | A | 10/1996 | Nalbandian et al. | |
| 5,589,842 | A | 12/1996 | Wang et al. | |
| 5,734,350 | A | 3/1998 | Deming et al. | |
| 6,133,880 | A | 10/2000 | Grangeat et al. | |
| 6,154,175 | A | 11/2000 | Yee | |
| 6,292,143 | B1 | 9/2001 | Romanofsky | |
| 6,304,220 | B1 | 10/2001 | Herve et al. | |
| 6,359,588 | B1 | 3/2002 | Kuntzch | |
| 6,593,887 | B2 * | 7/2003 | Luk et al. | 343/700 MS |
| 6,759,985 | B2 | 7/2004 | Acher et al. | |
| 6,768,456 | B1 | 7/2004 | Lalezari et al. | |
| 6,949,995 | B2 | 9/2005 | Choi et al. | |
| 6,980,171 | B2 | 12/2005 | Maruyama et al. | |
| 2002/0089457 | A1 | 7/2002 | Mehltretter | |
| 2004/0104847 | A1 | 6/2004 | Killen et al. | |
| 2004/0140945 | A1 | 7/2004 | Werner et al. | |
| 2004/0201526 | A1 | 10/2004 | Knowles et al. | |
| 2006/0017642 | A1 | 1/2006 | Herzer et al. | |

OTHER PUBLICATIONS

Nguyen, et al., "Ultra-Wideband Microstrip quasi-horn antenna", Electronic Letters, Jun. 7, 2001, vol. 37, No. 12, pp. 731-732.

Examiner, Danielidis, S., European Search Report for European Application No. EP 89 12 3278, completed Mar. 19, 1990, pp. 1-3.

* cited by examiner 318
320
324
304
326
322
308
332
328
316
104
312
314

304
104
308a
308
332
104
304
332
308b
308

EMBEDDED SURFACE WAVE ANTENNA WITH IMPROVED FREQUENCY BANDWIDTH AND RADIATION PERFORMANCE

FIELD

Embedded surface wave antenna methods and apparatuses having a relatively wide bandwidth and favorable pattern characteristics are provided.

BACKGROUND

In designing antenna structures, it is desirable to provide appropriate gain, bandwidth, beamwidth, sidelobe level, radiation efficiency, aperture efficiency, radar cross-section (RCS), radiation resistance and other electrical characteristics. It is also desirable for these structures to be lightweight, simple in design, inexpensive and unobtrusive, since an antenna is often required to be mounted upon or secured to a supporting structure or vehicle, such as high velocity aircraft, missiles, rockets or even artillery projectiles, which cannot tolerate excessive deviations from aerodynamic shapes. It is also sometimes desirable to hide the antenna structure so that its presence is not readily apparent for aesthetic and/or security purposes. Accordingly, it is desirable that an antenna be physically small in volume and not protrude on the external side of a mounting surface, such as an aircraft skin, while yet still exhibiting all the requisite electrical characteristics.

One type of antenna that has been successfully used for broadband conformal applications is the Doorstop™ antenna. The Doorstop™ antenna belongs to a class of antennas known as traveling wave antennas. Examples of other traveling wave antennas are polyrod, helix, long-wires, Yagi-Uda, log-periodic, slots and holes in waveguides, and horns. Antennas of this type have very nearly uniform current and voltage amplitude along their length. This characteristic is achieved by carefully transitioning from the element feed and properly terminating the antenna structure so that reflections are minimized. An example of a Doorstop™ antenna is found in U.S. Pat. No. 4,931,808, assigned to the assignee of the present invention, the entire disclosure of which is hereby incorporated herein by reference.

A Doorstop™ antenna generally comprises a feed placed over a dielectric wedge, a groundplane supporting or adjacent to the dielectric wedge, and a cover or radome. The Doorstop™ antenna has two principal regions of radiation that affect patterns: the feed region and the lens region. The size and shape of these two regions generally control bandwidth and pattern performance.

In a typical Doorstop™ antenna, the measured voltage standing wave ratio (VSWR) improves with increasing frequency. At reduced frequencies the Doorstop™ element is electrically too short and functions more like a bent monopole antenna. The low frequency limit for the Doorstop™ element is set by the electrical depth of the element. More particularly, the maximum wedge depth and wedge dielectric constant determine the lowest frequency of operation. Once the physical depth and dielectric constant of the wedge are established, the lens to feed length ratio of the basic Doorstop™ configuration determines the pattern performance. At low frequencies, the pattern tends to look very uniform and nearly omnidirectional, while at high frequencies the pattern becomes quite directional or end-fired. Additionally, at high frequencies the pattern develops a characteristic null at the zenith that moves forward toward the horizon as the frequency increases.

For certain applications and greater operating bandwidths, this characteristic pattern performance is undesirable.

Within about a 3 to 1 operating bandwidth, the pattern characteristic can be controlled by adjusting the lens to feed length ratio of the antenna. As the frequency increases above the 3 to 1 ratio, the lens becomes electrically long, producing field components that either support or interfere with the radiation from the feed region. This leads to the creation of nulls in the forward portion of the farfield elevation plane pattern.

Other aspects of the typical Doorstop™ antenna that degrade performance include the use of an unsupported (not grounded) microstrip line near the coax feed, which adversely affects the element impedance match. Also, the coaxial pin typically used to interconnect the feed to a transmission line and the microstrip line are sources of radiation, that can degrade pattern performance by creating pattern nulls at certain angles. In addition, trapped energy in the dielectric wedge results in large impedance variation at low frequencies. As still another disadvantageous feature, because the element feed of a typical Doorstop™ antenna is on the surface of the device, it is exposed to improper handling and high temperatures that cause variation in radio-frequency (RF) performance.

SUMMARY

Embodiments of the present invention are directed to solving these and other problems and disadvantages of the prior art. In accordance with embodiments of the present invention, Doorstop™ antenna elements having improved high frequency and/or low frequency performance characteristics are provided. In one aspect, radar absorbing material (RAM) is incorporated to improve low frequency performance. In another aspect, a lens perturbation feature is incorporated into a Doorstop™ antenna element to reduce nulls at angles of interest and at high frequencies. In still another aspect, a buried feed arrangement is provided, improving the low frequency performance characteristics of the antenna element, and improving resistance to adverse effects of high operating temperatures and/or improper handling of the antenna element.

The incorporation of a dielectric comprising a RAM or other lossy material in the feed region of the antenna element can reduce low frequency reflections without overly degrading high frequency performance. The lossy material may be combined with a feed mirror to further improve performance of the element at low frequencies, without unduly affecting high frequency performance.

Lens perturbation features in accordance with embodiments of the present invention generally include features to control or shape the wave or phase front of a signal. Accordingly, a lens perturbation feature may comprise the inclusion of volumes of differential dielectric material within the lens portion of the antenna element. For example, a wedge of dielectric material having a relatively low dielectric constant may be inserted in a forward portion of the lens region, while the remaining portion of the lens region may incorporate a dielectric material having a relatively high dielectric constant. In accordance with further embodiments of the present invention, a lens perturbation feature may include shaping the ground plane in the lens region of the antenna element to control the shape of the phase front.

A buried feed feature in accordance with embodiments of the present invention may include a feed that is covered by relatively low dielectric constant material in a feed region or on a feed side of the feed element. The lens region on a side of the feed element opposite the feed side may incorporate a dielectric material having a relatively high dielectric constant. In addition, an antenna element with a buried feed may provide a coaxial or other connector for interconnecting the feed element to a transmission line that lies under the dielectric material generally filling the volume defined by the ground plane.

Additional features and advantages of the present invention will become more readily apparent from the following description, particularly when taken together with the accompanying drawings.

DETAILED DESCRIPTION

Embodiments of the present invention are generally directed to providing antenna elements that are particularly suited for conformal applications. More particularly, embodiments of the present invention provide design features that assist in improving the performance of embedded surface wave antenna elements. In general, improving performance refers to providing more favorable bandwidth and radiation performance in areas of interest than would otherwise be available from a comparable embedded surface wave antenna element. Certain of the design features are particularly effective at improving performance at low frequencies, while other design features are particularly effective at improving performance at high frequencies. As used herein, "low frequencies" and "high frequencies" are not limited to any particular frequency ranges. Instead, these terms respectively apply to the low end and the high end of the overall range of operating frequencies of the antenna element. In addition, through the application of features in accordance with embodiments of the present invention, the useful overall operating range of an antenna element can be improved as compared to an element that did not benefit from the use of such features, through improvements to the beam patterns at the low and/or high frequency ends of the overall operating range.

Figure 1:
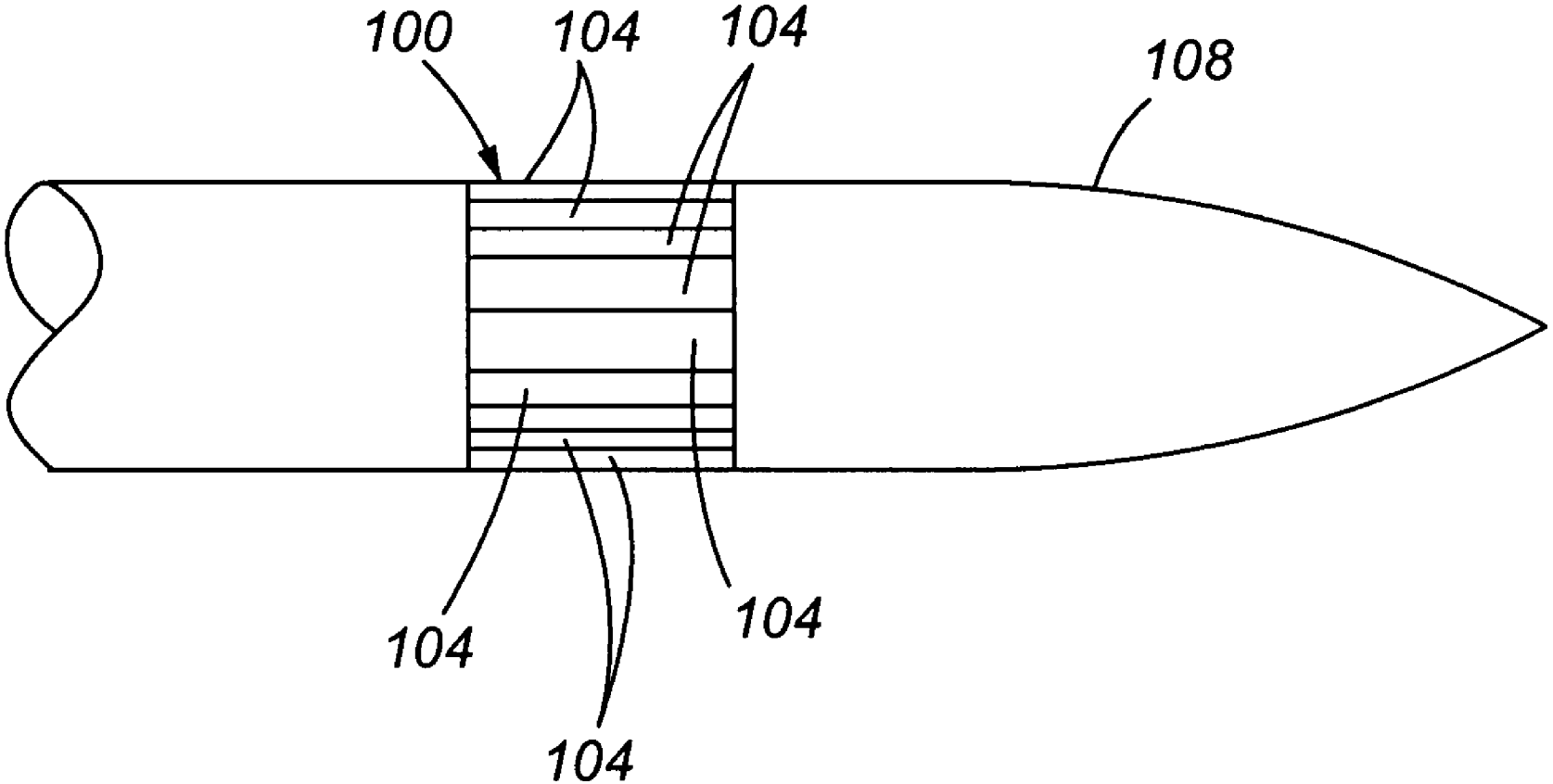
FIG. 1 is a partial side view of a vehicle incorporating a number of antenna elements in accordance with embodiments of the present invention.

With reference to FIG. 1, an array 100 comprising a plurality of antenna elements 104 in accordance with embodiments of the present invention are shown incorporated into a vehicle 108. Although the vehicle 108 is illustrated as a missile, such as an advanced radar tracking air-to-air missile, this is just one example of the type of vehicle that can be associated with one or more antenna elements 104 described herein. Other examples include aircraft, spacecraft, satellites, ships, tanks, trucks, cars and artillery projectiles. Furthermore, embodiments of the present invention are not limited to being associated with a vehicle 108, and can instead be associated with stationary or man-portable applications. Antenna elements 104 in accordance with embodiments of the present invention are particularly useful in connection with any application that requires or can benefit from a conformal or substantially conformal antenna element. Furthermore, a number of antenna elements 104 having forward-looking and side-looking beam coverage can be arrayed about the periphery of a vehicle 108, for example to provide a composite hemispherical coverage volume or beam. As can be appreciated by one of skill in the art, the number of antenna elements 104 included in an array 100 can be selected based on considerations such as frequency band of operation and the desired coverage region.

Figures 2A, 2B, 2C:
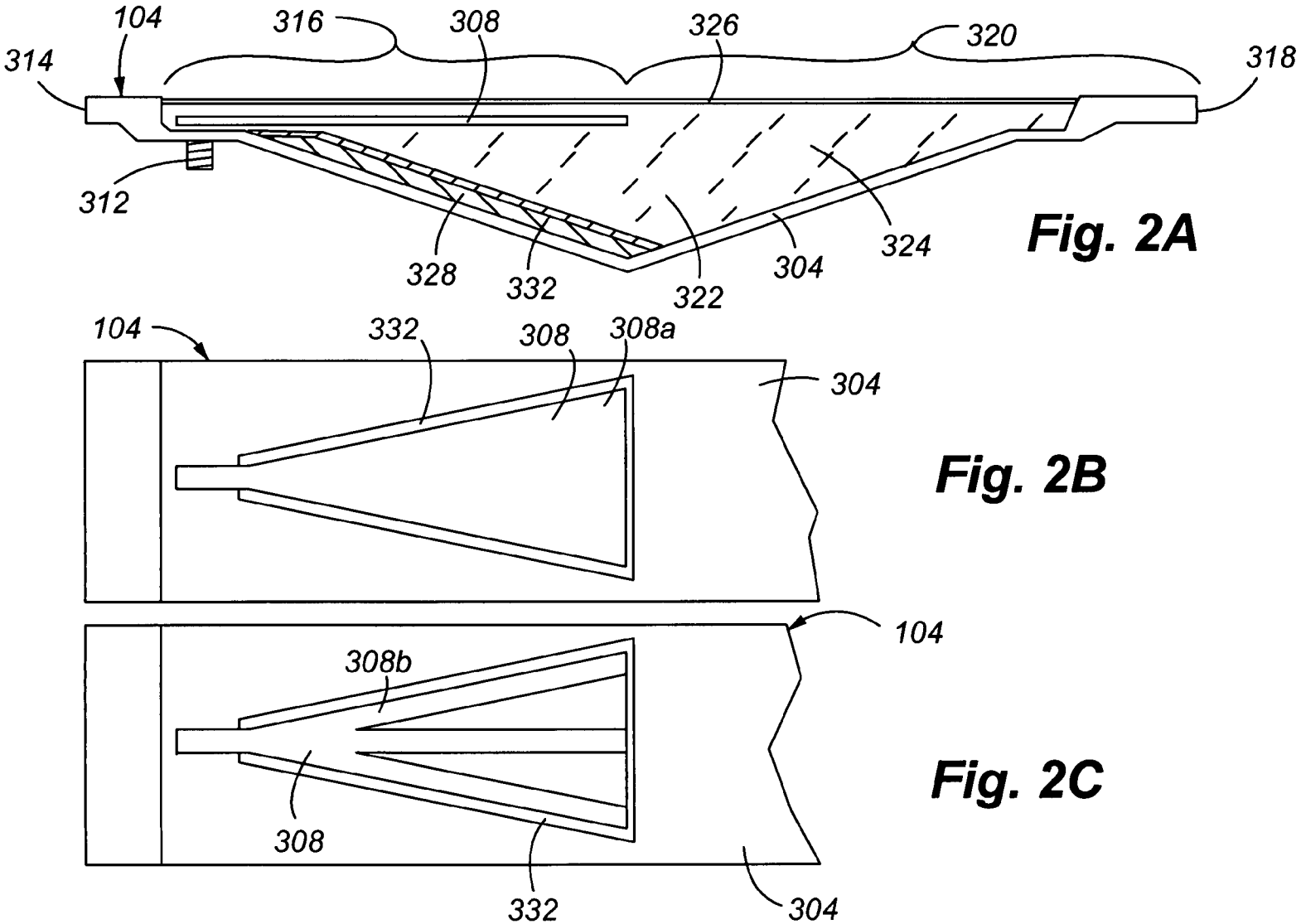
FIG. 2A is a cross-section of an antenna element in accordance with embodiments of the present invention.
FIG. 2B is a plan view of a portion of an antenna element in accordance with embodiments of the present invention.
FIG. 2C is a plan view of a portion of an antenna element in accordance with other embodiments of the present invention.

FIG. 2A is a cross-sectional view of an antenna element 104 in accordance with embodiments of the present invention in elevation. In general, the antenna element 104 comprises a ground plane or means for establishing a ground plane 304 and a feed or means for feeding a signal 308. A connector 312 is provided at or towards a proximal end 314 of the antenna element. Typically, the connector 312 allows the signal line of a coaxial cable or other transmission line to be interconnected to the feed 308, and the ground to be connected to the ground plane 304. The region including the proximal end of the antenna element 104 and containing the feed 308 is generally defined as the feed region 316. The region including the distal end 318 of the antenna element 104 is generally defined as the lens region 320. A first or supporting dielectric material 324 generally fills all or a portion of a volume 322 defined by the ground plane 304, and is generally disposed between the ground plane 304 and the feed 308. The first dielectric material 324, in accordance with embodiments of the present invention, supports the feed 308 and/or separates the feed 308 from the ground plane 304, and therefore comprises a means for supporting the feed 308. A radome 326 can be provided, for example to provide a surface that conforms to the exterior surface of a vehicle 108 incorporating the antenna element 104, and to protect the feed 308 and other components of the antenna element 104. In general, the radome 326 encloses or forms a boundary of the volume 322 defined by the ground plane 304. As can be appreciated by one of skill in the art after consideration of the present disclosure, the volume 322 need not be a closed volume, in that it may be open to volumes associated with antenna elements on either side of the antenna element under consideration, and/or the volume may not be enclosed by a radome 326.

In the embodiment illustrated in FIG. 2A, a second dielectric material or feed loading dielectric material 328, in this example comprising a radar absorbing material (RAM) or means for absorbing radio frequency energy, is disposed in the feed region 316, between the feed 308 and the ground plane 304. The incorporation of a feed loading dielectric 328 comprising a RAM in this area can improve the low frequency performance of the antenna element 104. Without wishing to be bound by any particular theory, it is believed that the loading feed dielectric material 328 improves low frequency performance by loading the feed 308 and by absorbing low frequency energy that would otherwise become trapped in the feed region 316, and which can reflect and destructively interfere with energy at desired wavelengths. In addition, a feed mirror 332 can be provided. The feed mirror 332 can comprise a metallization or other conductive layer that is applied over the RAM 328. The feed mirror 332 is electrically connected to the groundplane, and generally assists in improving the performance of the antenna element 104 at high frequencies.

In FIG. 2B, the antenna element 104 shown in FIG. 2A is illustrated in plan view, with the radome 326 removed, and with the first dielectric 324 treated as a transparent feature (or alternatively with the first dielectric removed) to provide a view of the feed 308 and the feed mirror 332. More particularly, an antenna element 104 with a conventional feed 308*a* is illustrated. In addition, it can be seen that the feed mirror 332 may have an area that generally follows or is equal to the area of the feed 308.

In FIG. 2C, another embodiment of the antenna element 104 shown in FIG. 2A is illustrated in plan view, again with certain features removed or not illustrated to provide a view of the feed 308 and the feed mirror 332. More particularly, an antenna element 104 with a crow's foot type feed 308*b* is illustrated. As can be appreciated by one of skill in the art, the crow's foot type feed 308*b* can provide a reduced radar cross section (RCS) as compared to the conventional feed 308*a*. The feed mirror 332 may have an area that generally follows or is equal to the outline of the area of the feed 308. Alternatively, the feed mirror 332 may also have a crow's foot type outline.

Figure 3:
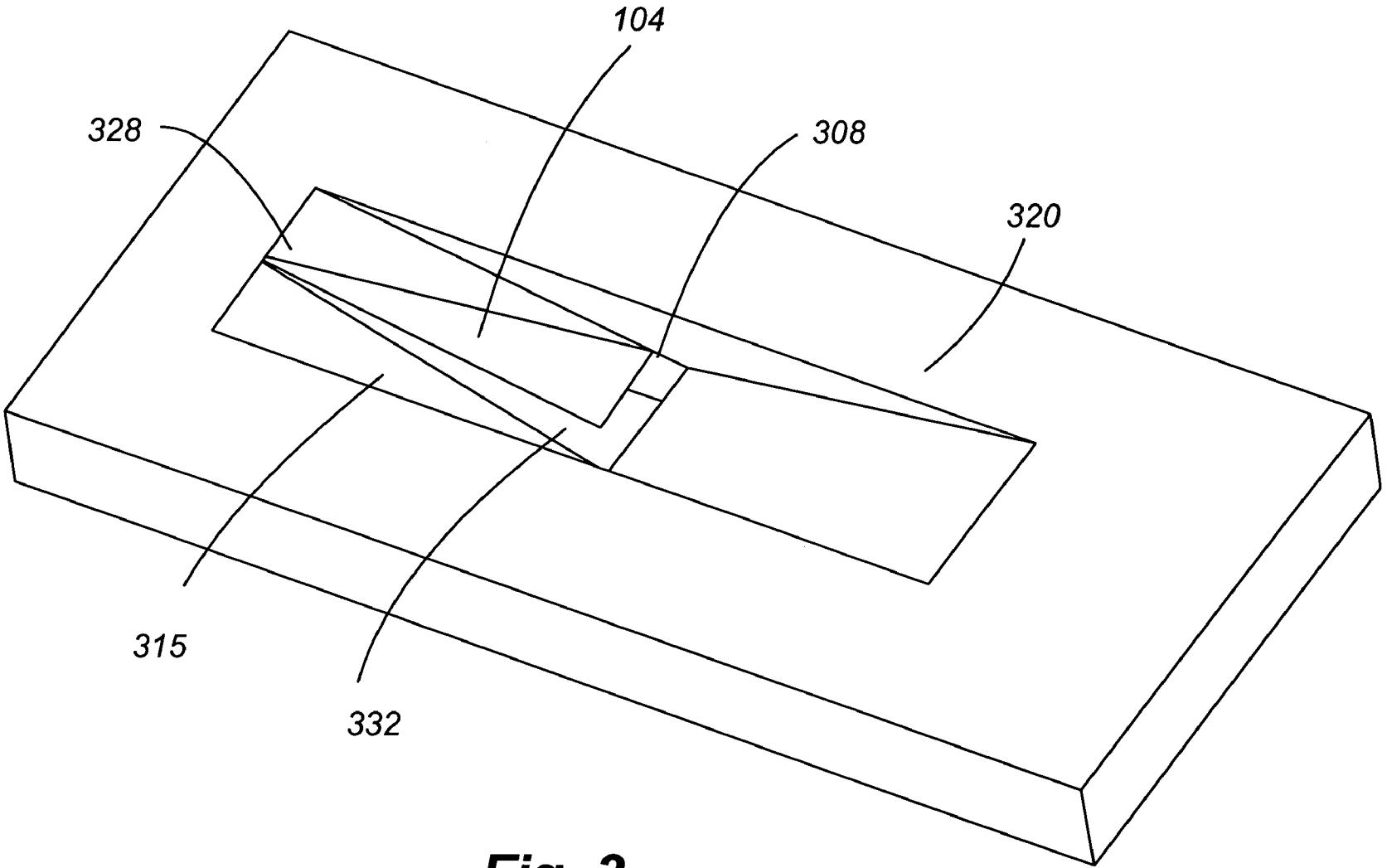
FIG. 3 is a perspective view of an antenna element in accordance with embodiments of the present invention.

A perspective view of the embodiment of the antenna element 104 shown in FIGS. 2A and 2B is shown in FIG. 3 with the radome 326 and first dielectric 324 removed (or not illustrated). As shown, the ground plane 304 can comprise a body extending to the sides of the antenna element 104. Accordingly, the ground plane 304 can comprise a structural component of a vehicle 108 incorporating the antenna element. In addition, the RAM 328 can extend across the lower surface of the ground plane 304, to cover an area corresponding to the feed region 316. RAM is generally omitted from the lens region 320 in order to avoid decreasing the gain of the antenna element 104 at high frequencies.

Figure 4:
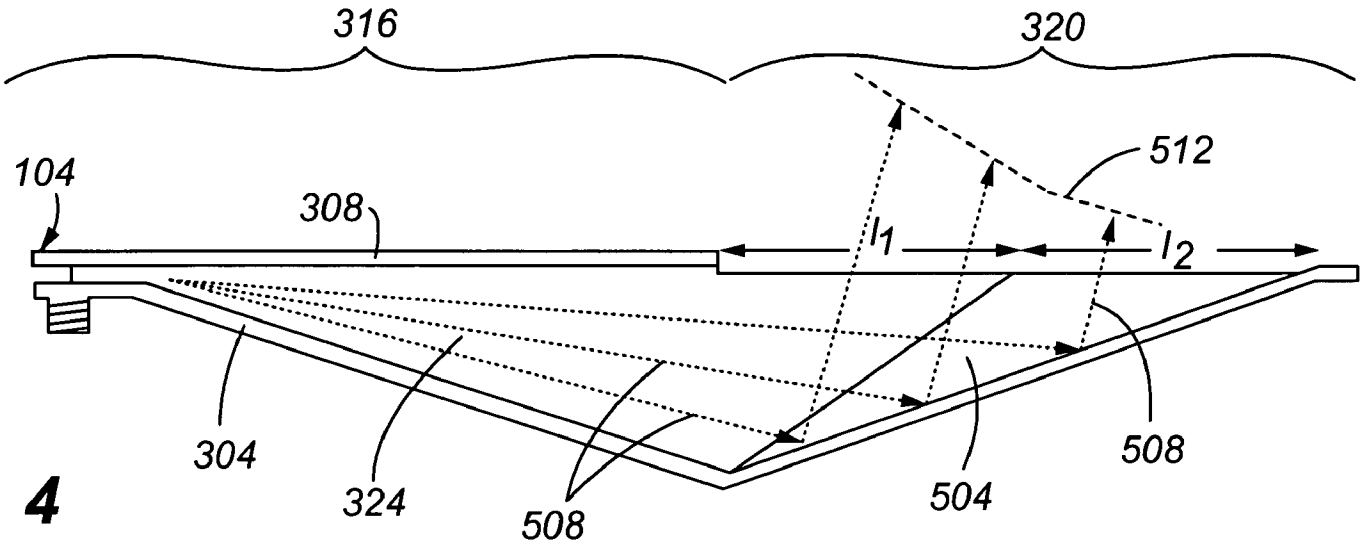
FIG. 4 is a cross-section of an antenna element in accordance with other embodiments of the present invention.

FIG. 4 is a cross-sectional view of an antenna element 104 featuring a lens perturbation feature or means for altering a phase front of a signal in accordance with other embodiments of the present invention in elevation. In such embodiments, a second dielectric material or lens perturbation dielectric material 504 is disposed at the distal end of the antenna element 104, within the lens region 320 of the antenna element 104. The lens perturbation dielectric material 504 may feature a lower dielectric constant than the first dielectric material 324. By providing a lens perturbation dielectric material 504 having a dielectric constant that is different than the dielectric constant of the first dielectric material 324, the velocity of energy through the antenna element 104 can be changed. Furthermore, because the lens perturbation dielectric material 504 is located in the lens region 320 of the antenna element 104, it can be particularly effective at altering the high frequency performance of the antenna element 104. In particular, as illustrated by the rays 508 generally depicting paths of high frequency energy radiated by the antenna element 104, the phase front 512 of the resulting beam can be altered or curved. By altering the phase front 512 so that the energy vectors produced by the different sources within the antenna element add constructively in the far field (or at least so that destructive interference is avoided), nulls within the beam can be avoided. As shown, the lens perturbation dielectric material 504 can be provided as a wedge-shaped volume disposed towards the distal end of the antenna element and adjacent the ground plane 304 that is larger adjacent or near the radome 326 (not illustrated in FIG. 4) than at the opposite end. This general configuration has been determined to be particularly useful in avoiding nulls in the far field at relatively high frequencies.

The effect on the phase front 512 can be modified by changing the relative dielectric constants of the dielectric materials 324, 504. Typically, the materials have dielectric constants that differ from one another by about a 2 to 1 ratio. For example, the first dielectric material 324 may have a dielectric constant of about 3.6, and the lens perturbation dielectric material 504 may have a dielectric constant of about 1.8. The effect on the phase front 512 can also be modified by changing the depth of the wedge comprising the lens perturbation dielectric material 504. This depth can be characterized by the dimensions illustrated as $l_1$ and $l_2$ in FIG. 4. For most applications, the length of $l_2$ should be within from about 33 to about 50% the distance $l_1$ plus $l_2$. This relationship has been found to provide a desirable range of modification to the phase front 512 where the first dielectric material 324 has a dielectric constant that is about twice the dielectric constant of the lens perturbation dielectric material 504.

Figure 5:
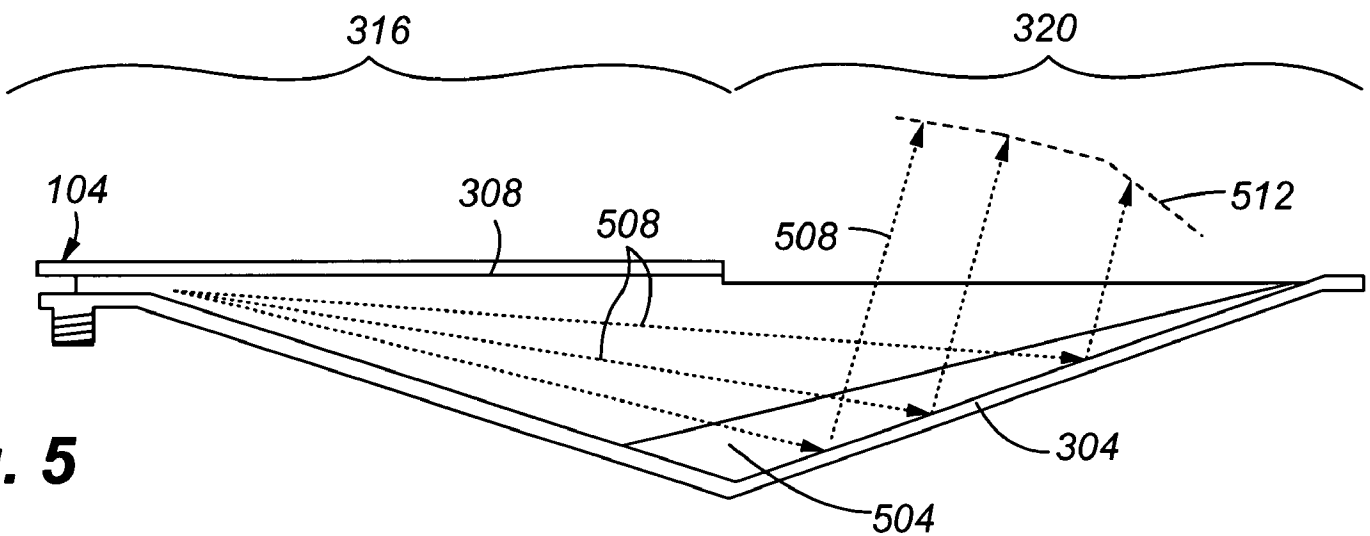
FIG. 5 is a cross-section of an antenna element in accordance with other embodiments of the present invention.

An alternative configuration of an antenna element 104 incorporating a lens perturbation feature in the form of a lens perturbation dielectric material 504 disposed in the lens region 320 is illustrated in FIG. 5. The lens perturbation dielectric material 504 can have a dielectric constant that is higher than the dielectric constant of the first dielectric material 324. The lens perturbation dielectric material 504 also can be provided as a wedge shaped volume at the distal end of the first dielectric material 324, and can be larger at an end that is within or near the feed region 316 of the antenna element 104, and smaller adjacent or near the radome 326 (not illustrated in FIG. 5). As depicted in FIG. 5, this configuration can alter the velocity of rays 508 to produce a phase front 512 that is altered or curved in a reverse direction as compared to the embodiment illustrated in FIG. 4.

Figure 6:
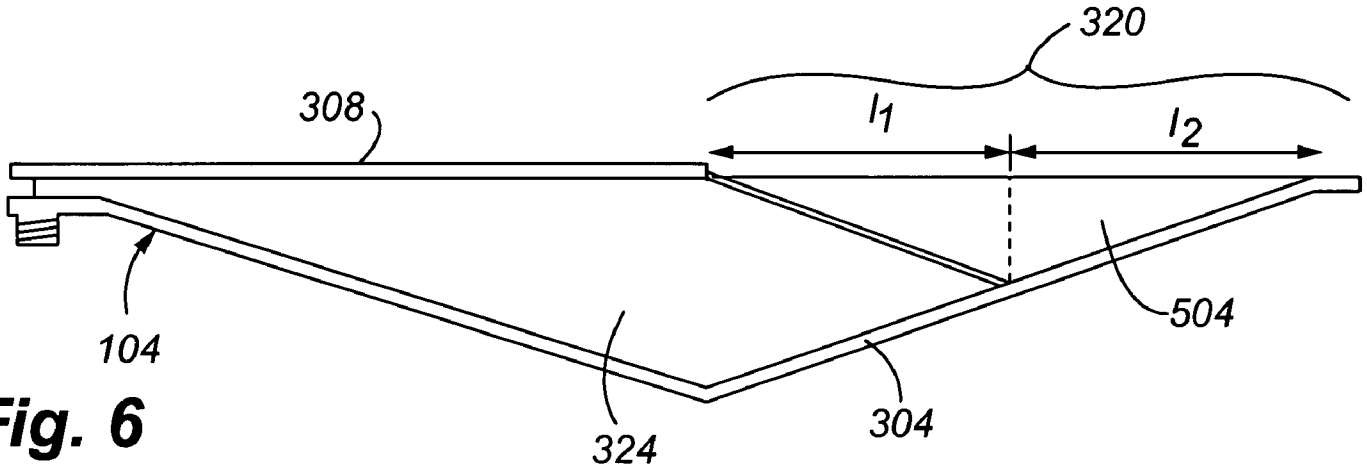
FIG. 6 is a cross-section of an antenna element in accordance with other embodiments of the present invention.

Another alternative configuration of an antenna element 104 incorporating a lens perturbation feature in the form of a second dielectric material comprising lens perturbation material 504 in order to improve high frequency performance is illustrated in FIG. 6. In such embodiments, the lens perturbation dielectric material 504 is deployed within the lens region 320 of the antenna element 304. The lens perturbation dielectric material may further be configured such that it describes a generally wedge shaped volume with a first surface that would be adjacent a radome 326 (not illustrated in FIG. 6), a second surface that is proximate to the ground plane at or towards a proximate end of the ground plane 304, and a third surface that extends from the ground plane 304 to or towards the distal end of the feed 308. The lens perturbation dielectric material 504 has a dielectric constant that is less than the dielectric constant of the first dielectric material 324. For example, the dielectric constant of the lens perturbation dielectric material 504 may be about one-half the dielectric constant of the first dielectric material 324. The depth of the wedge shaped volume defined by the lens perturbation dielectric material 504 may be characterized by the dimensions $l_1$ and $l_2$. For most applications, $l_2$ should be about 33 to 50% the total length of $l_1$ plus $l_2$.

Figure 7:
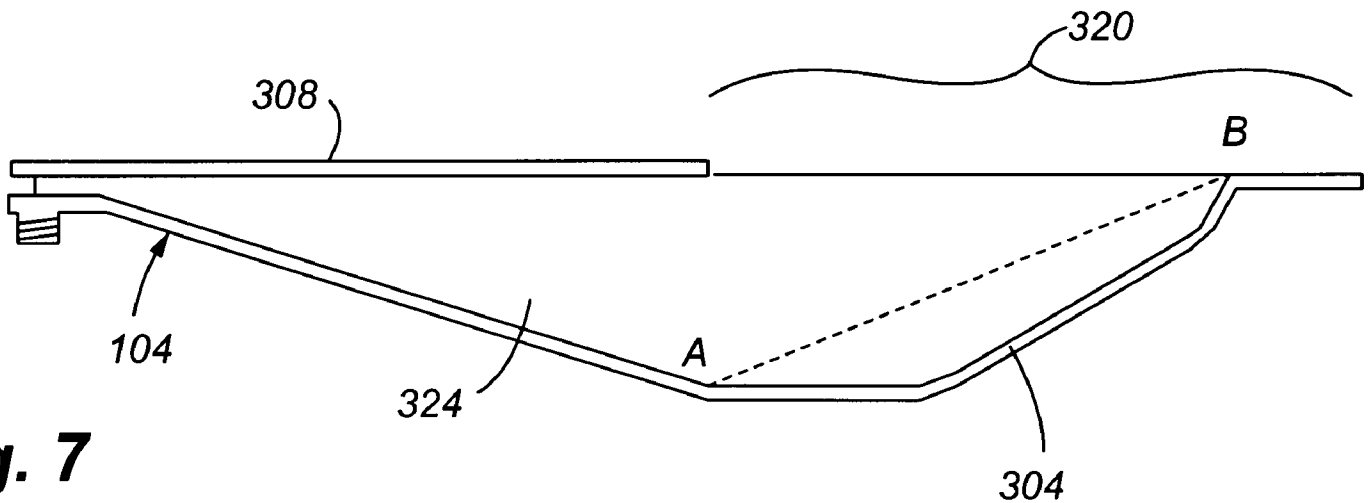
FIG. 7 is a cross-section of an antenna element in accordance with other embodiments of the present invention.

The high frequency performance of an antenna element 104 can also be altered by providing a lens perturbation feature or means for altering a phase front of a signal in the form of ground plane 304 having an altered shape within the lens region 320. For example, as illustrated in FIG. 7, the ground plane 304 can be contoured such that it is generally concave in cross section with respect to the volume defined by the ground plane. More particularly, the ground plane 304 can be contoured such that the distance of the ground plane 304 from the distal lens of the feed 308 along at least a first line changes at a non-linear rate along at least a portion of the ground plane 304 in the lens region 320 of the antenna element. For instance, whereas a ground plane might otherwise follow line A-B in FIG. 7, by dishing or contouring the ground plane 304, the phase front of a beam can be altered to improve or adjust far field performance.

Figure 8:
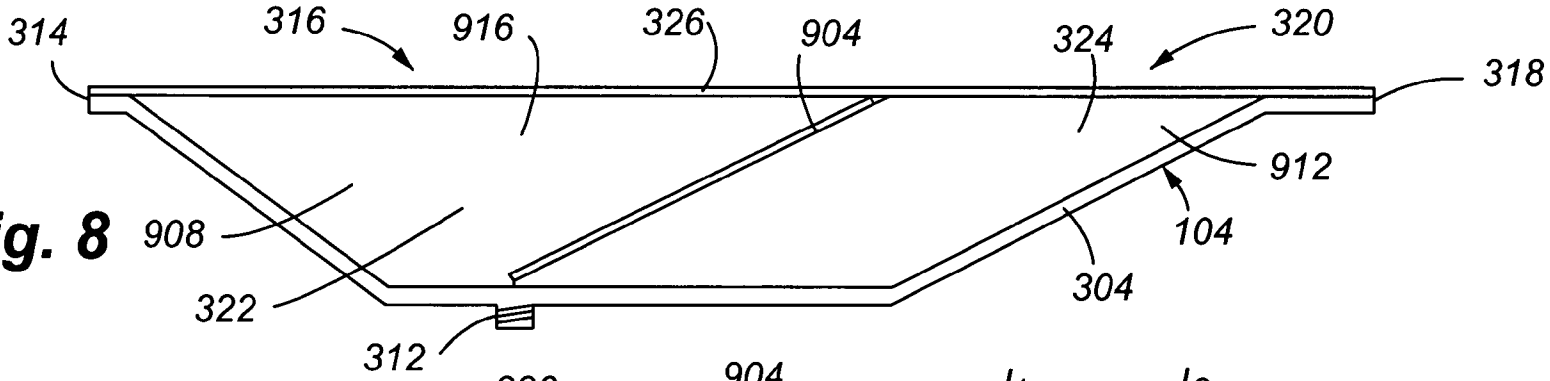
FIG. 8 is a cross-section of an antenna element in accordance with other embodiments of the present invention.

FIG. 8 depicts an antenna element 104 in accordance with embodiments of the present invention having a feed 904 comprising a buried feed. According to such embodiments, the feed is "buried" within or between a first or supporting dielectric material 324 and second or feed region dielectric materials 908. For instance, the feed 904 may extend from a point proximate to the ground plane 304 to a point proximate to the radome 326, effectively dividing the volume 322 defined by the ground plane 304 into two sub-volumes, a distal sub-volume 912 and proximate sub-volume 916. Furthermore, a "top" surface of the feed 904 may be overlayed by the second dielectric material 908 generally filling the proximate sub-volume 912, while the "bottom" surface of the feed 904 generally facing the lens region 320 may be supported by or adjacent to the first dielectric material 324, generally filling the distal sub-volume 916. In accordance with embodiments of the present invention, the first 324 and second 908 dielectric materials may have different dielectric constants. In general, providing a buried feed 904 allows the feed 904 to transition directly (or more directly) to the feature or connector 312 that comprises an interconnection to the transmission line. In addition, spurious radiation that can couple to neighboring elements 104 (for example within a common array 100), launch surface waves, and adversely affect radiation patterns, can be reduced. Moreover, more energy can be directed from the feed region 316 and into the lens region 320. Also, less energy is trapped in the antenna element 104, because fewer standing waves are set-up within the antenna element 104. The use of a buried feed 904 also provides improved protection for the feed 904 from mishandling during manufacture or installation of the antenna element 104, and from high temperatures during operation of the antenna element 104, for example in connection with a vehicle 108 traveling through the atmosphere at a high velocity.

Figure 9:
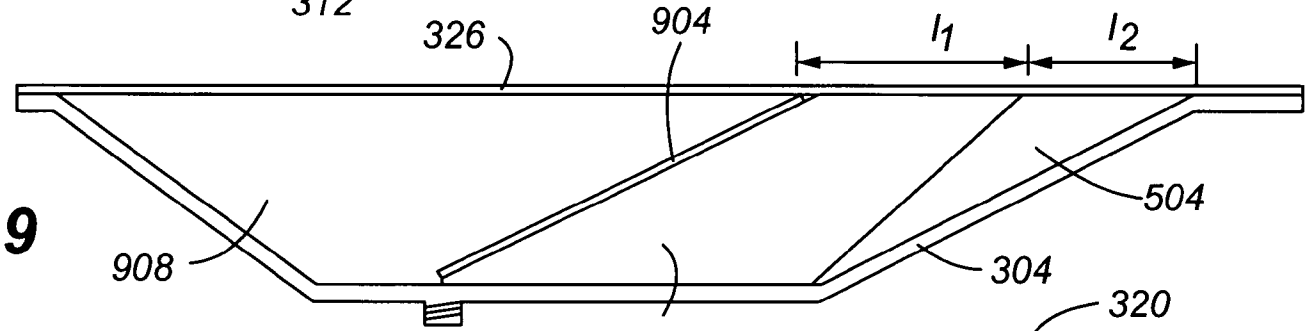
FIG. 9 is a cross-section of an antenna element in accordance with other embodiments of the present invention.

Many of the improvements in performance obtained through use of a buried feed 904 are seen in the low frequency range. In order to improve high frequency performance, the buried feed 904 configuration can be combined with lens perturbation features of other embodiments, such as the incorporation of a wedge or volume of lens perturbation dielectric material 504 having a relatively low dielectric constant in the lens region 320 of the antenna element 104. Such an embodiment is illustrated in FIG. 9. Accordingly, at least three distinct volumes of dielectric materials 324, 504, 908 are included in the antenna element 104 in accordance with such embodiments.

Figure 10:
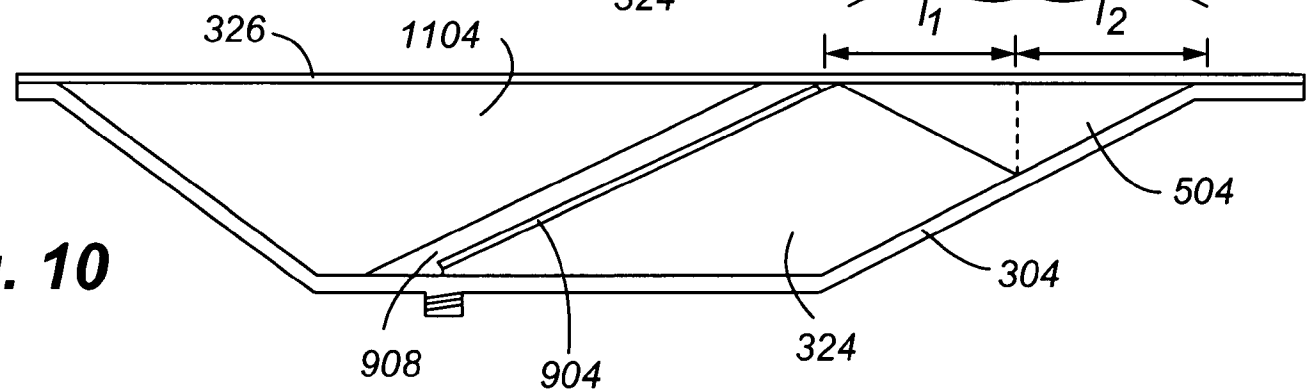
FIG. 10 is a cross-section of an antenna element in accordance with other embodiments of the present invention.

The advantages of the buried feed configuration can be enhanced by providing another dielectric material in the form of a radar absorbing material or means for absorbing radio-frequency energy 1104 in a volume between the feed 904 and the radome 326, on a side of the feed 904 opposite the lens region 320 (See FIG. 10). In particular, providing radar absorbing material 1104 above the feed can absorb trapped energy, improving low frequency performance, with only a relatively small adverse effect on high frequency performance. The radar absorbing material 1104 can be separated from the feed 904 by a feed region dielectric material 908. As shown, this configuration can (but need not) be combined with a volume of lens perturbation dielectric material 504 within the lens region 320 that is different than other dielectric material 324 in the lens region 320.

Figure 11:
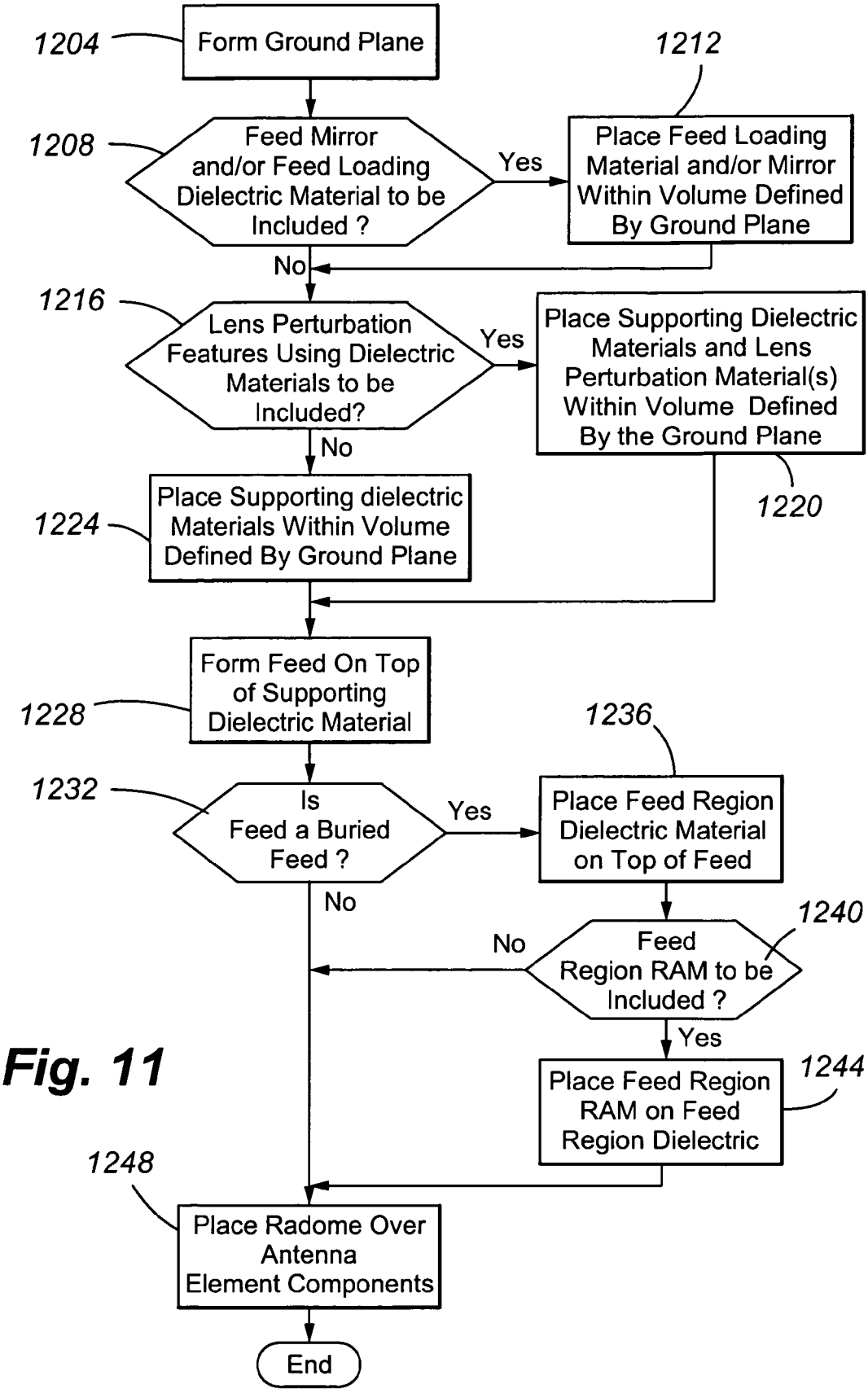
FIG. 11 is a flow chart illustrating aspects of a method for framing an antenna element in accordance with embodiments of the present invention.

With reference now to FIG. 11, the manufacture of an antenna element 104 in accordance with embodiments of the present invention is illustrated. Initially, at step 1204, a ground plane 304 is formed. Formation of the ground plane 304 can comprise contouring a flat piece of conductive material to have the desired shape, for example by stamping. Alternatively, forming the ground plane can comprise machining a piece of conducting material. Where a number of antenna elements 104 are used together in an array 100, forming the ground plane 304 can comprise forming the ground planes 304 for a number of the antenna elements 104 simultaneously or at about the same time. For instance, forming the ground plane 304 can comprise forming a shape of revolution comprising the ground planes 304 for each element 104 within an array 100 from a piece of conductive material forming a structural portion of a vehicle 108.

At step 1208, determination is made as to whether a feed mirror 332 and/or a feed loading dielectric material 328 is to be included in the antenna element 104. If such features are to be included, the feed loading material 328 or the feed mirror 332 are placed within the volume defined by the ground plane 304. For example, the feed loading material 328 comprising a dielectric radar absorbing material may be later placed on a portion of the ground plane 304 corresponding to the feed region 316, and the feed mirror 332 may be formed on top of the radar absorbing material 328.

At step 1216, determination is made as to whether lens perturbation features using dielectric materials are to be included in the antenna element 104. If such lens perturbation features are to be included, supporting dielectric material 324 and lens perturbation material or materials 504 are placed within the volume defined by the ground plane 304. Furthermore, these materials may be placed in the lens region 320 of the antenna element 104. If it is determined that lens perturbation features using dielectric materials are not to be included in the antenna element 104, supporting dielectric material 324 is placed within the volume defined by the ground plane 304, and in particular within a volume including at least a portion of the lens region 320 of the antenna element 104.

At step 1228, the feed 308 or 904 is formed on top of the dielectric material 324. For example, a conductive foil or film may be laid on top of the supporting dielectric material 324 and interconnected to the connector 312. A determination may then be made as to whether the feed is a buried feed 904. Where the feed is a buried feed 904, another dielectric material 908 can then be placed on top of the feed 904 (step 1236). After placing feed region dielectric material 908 on top of the feed, a determination may be made as to whether feed region RAM 1104 is to be included (step 1240). If feed region RAM is to be included, the feed region RAM 1104 is placed on the feed region dielectric material 908 (step 1244). After determining, that the feed is not a buried feed, or after placing feed region dielectric material and/or feed region RAM, a radome 326 may be placed over the antenna element 104 components (step 1248). As can be appreciated by one of skill in the art, a radome 326 is not required. Furthermore, radome 326 may be placed over antenna element 104 components after installation of the antenna element 104 in a vehicle 108 or other structure. In addition, after placement of the antenna element 104 in a vehicle 108 or other structure, the connector 312 may be joined to a transmission line.

As can be appreciated by one of skill in the art and after consideration of the present disclosure, the required shape of the dielectric materials 324, 328, 504, 908 and/or 1104 may be fairly complex. Accordingly, the material or materials 324, 328, 504, 908 and/or 1104 may be molded into the final shape (or near the final shape), in order to avoid or reduce machining or milling operations.

Although various embodiments of the antenna elements 104 are described herein have been illustrated having wedges or volumes of dielectric materials with sharp angles between surfaces, it should be appreciated that other configurations are possible. For example, curved interfaces between adjacent materials can be used to lower the radar cross-section of the antenna element 104.

As can be appreciated by one of skill in the art from the description provided herein, various of the features provided herein can be used in combination to provide improved antenna performance at low and high frequencies. Furthermore, it can be appreciated that combinations in addition to those illustrated are possible. For example, multiple lens perturbation features in the form of multiple volumes of lens perturbation dielectric materials may be provided. As a further example, a lens perturbation feature comprising one or more lens perturbation dielectric materials 504 can be combined with a lens perturbation feature comprising a curved ground plane 304. As still another example, a buried feed 904 and/or loaded feed 308 or 904 can be combined with any of the lens perturbation features. In addition, although operation of an antenna element incorporating features described herein has at times been described in connection with the transmission of radio frequency or microwave energy, it can be appreciated that embodiments of the present invention also have application in connection with improving the performance of antenna elements operating to receive radio frequency or microwave energy.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with the various modifications required by their particular application or use of the invention. It is intended that the appended claims be construed to include alternative embodiments to the extent permitted by the prior art.

What is claimed is:

1. An antenna element, comprising:

a ground plane defining a volume;

a feed, wherein said feed includes a proximate end and a distal end;

a first dielectric material, wherein the first dielectric material is included in the volume defined by the ground plane, and wherein at least a portion of the first dielectric material is located between the feed and the ground plane; and a second dielectric material, wherein at least a portion of the second dielectric material is also included in the volume defined by the ground plane, wherein the first dielectric material and the second dielectric material, taken together with one another, fill substantially all of the volume defined by the ground plane, wherein the first dielectric material has a first dielectric constant, wherein the second dielectric material has a second dielectric constant, wherein the first and second dielectric constants are different from one another, and wherein the first and second dielectric materials form at least part of a lens perturbation feature.

2. The antenna element of claim 1, further comprising:

a radome, wherein the radome forms a boundary of the volume defined by the ground plane.

3. The antenna element of claim 1, wherein the first dielectric material and the second dielectric material comprise the lens perturbation feature.

4. An antenna element, comprising:

a ground plane defining a volume;

a feed, wherein said feed includes a proximate end and a distal end;

a first dielectric material, wherein the first dielectric material is included in the volume defined by the ground plane, and wherein at least a portion of the first dielectric material is located between the feed and the ground plane;

a second dielectric material, wherein at least a portion of the second dielectric material is also included in the volume defined by the ground plane; and a lens perturbation feature in a lens region of said antenna element.

5. The antenna element of claim 4, wherein the first dielectric has a first dielectric constant, wherein the second dielectric has a second dielectric constant that is different than the first dielectric constant, and wherein the lens perturbation feature comprises a first portion of the lens region including the first dielectric material and a second portion of the lens region including the second dielectric material.

6. The antenna element of claim 5, wherein the first dielectric constant of the first dielectric material is greater than the second dielectric constant of the second dielectric material.

7. The antenna element of claim 6, wherein the first dielectric constant is about twice the second dielectric constant.

8. The antenna element of claim 4, wherein the lens perturbation feature comprises a ground plane having a distance from the distal end of the feed that changes at a non-linear rate along at least a portion of the ground plane located within the lens region of the antenna element.

9. An antenna element, comprising:

a ground plane defining a volume;

a feed, wherein said feed includes a proximate end and a distal end;

a first dielectric material, wherein the first dielectric material is included in the volume defined by the ground plane, and wherein at least a portion of the first dielectric material is located between the feed and the ground plane; and a second dielectric material, wherein at least a portion of the second dielectric material is also included in the volume defined by the ground plane, wherein the feed comprises a buried feed that extends through a portion of the volume to define at least first and second sub-volumes, wherein the first dielectric material is a supporting dielectric material located within the first sub-volume on a first side of the feed and the second dielectric material is a feed region dielectric material located within the second sub-volume on a second side of the feed.

10. The antenna element of claim 9, further comprising a third dielectric material, wherein the third dielectric comprises a lens perturbation dielectric material located in the first sub volume.

11. The antenna element of claim 10, further comprising a fourth dielectric comprising a radar absorbing material located in the second sub-volume.

12. An antenna element, comprising:

a ground plane defining a volume;

a feed, wherein said feed includes a proximate end and a distal end;

a first dielectric material, wherein the first dielectric material is included in the volume defined by the ground plane, and wherein at least a portion of the first dielectric material is located between the feed and the ground plane;

a second dielectric material, wherein at least a portion of the second dielectric material is also included in the volume defined by the ground plane; and a feed mirror, wherein a portion of the first dielectric is adjacent a first side of the feed mirror and at least a portion of the second dielectric is adjacent a second side of the feed mirror.

13. A method for forming an antenna, comprising:

forming a ground plane from an electrically conductive material, wherein a first surface of the ground plane defines a volume;

placing a first dielectric material within at least a first portion of the volume;

placing a second dielectric material within at least a second portion of the volume, wherein the first dielectric material and the second dielectric material generally fill the volume defined by the ground plane, wherein the first dielectric material has a first dielectric constant, wherein the second dielectric material has a second dielectric constant, wherein the first and second dielectric constants are different from one another, and wherein the antenna includes a lens perturbation feature comprising the first dielectric material and the second dielectric material; and forming a feed, wherein at least a portion of the first dielectric material is located between the feed and the ground plane.

14. The method of claim 13, further comprising:

placing a radome over the feed and the dielectric materials, wherein the radome forms a boundary of the volume generally filled by the first and second dielectric materials.

15. A method for forming an antenna, comprising:

forming a ground plane from an electrically conductive material, wherein a first surface of the ground plane defines a volume;

placing a first dielectric material within at least a first portion of the volume;

placing a second dielectric material within at least a second portion of the volume, wherein the first dielectric material has a dielectric constant that is about twice the dielectric constant of the second dielectric material; and forming a feed, wherein at least a portion of the first dielectric material is located between the feed and the ground plane.

16. The method of claim 15, wherein placing the second dielectric material comprises placing the second dielectric material at a distal end of the volume, within a lens region of the antenna to form a lens perturbation feature.

17. The method of claim 16, further comprising:

placing a third dielectric material comprising a feed region dielectric material within at least a third portion of the volume, wherein the first and second dielectric materials are located on a first side of the feed and the third dielectric material is located on a second side of the feed.

18. The method of claim 17, further comprising:

placing a fourth dielectric material comprising a radar absorbing material within at least a fourth portion of the volume, wherein the third dielectric material is placed on the second side of the feed.

19. A method for forming an antenna, comprising:

forming a ground plane from an electrically conductive material, wherein a first surface of the ground plane defines a volume;

placing a first dielectric material within at least a first portion of the volume;

placing a second dielectric material within at least a second portion of the volume;

forming a feed, wherein at least a portion of the first dielectric material is located between the feed and the ground plane; and forming a feed mirror over the second dielectric material.

20. An antenna apparatus, comprising:

means for establishing a ground plane, wherein said means for establishing a ground plane defines a volume;

means for feeding a signal;

means for supporting said means for feeding a signal, wherein said means for supporting are located within said volume; and means for altering a phase front of a signal, wherein said means for altering a phase front of a signal comprises means for perturbing a propagation velocity of a signal, wherein said means for perturbing is located within said volume.

21. The antenna apparatus of claim 20, wherein said means for feeding a signal divides said volume into a proximal volume and a distal volume, wherein said means for supporting and said means for perturbing are located in said distal volume, the apparatus further comprising:

feed region dielectric means located in said proximal volume; and means for absorbing radio frequency energy located in said proximal volume.

* * * * *

UNITED STATES PATENT AND TRADEMARK OFFICE

CERTIFICATE OF CORRECTION

PATENT NO. : 7,595,765 B1
APPLICATION NO. : 11/479431
DATED : September 29, 2009
INVENTOR(S) : Hirsch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 605 days.

Signed and Sealed this

Twenty-eighth Day of September, 2010

David J. Kappos

David J. Kappos
*Director of the United States Patent and Trademark Office*